United States Patent [19]

Bruff et al.

[11] 4,328,787

[45] May 11, 1982

[54] METHOD AND ARRANGEMENT FOR MELTING OF PITCH ETC.

[75] Inventors: William Bruff; Kjell B. Petersen, both of Kristiansand, Norway

[73] Assignee: Mosal Aluminium, Elkem-Spigerverket A/S & Co., Oslo, Norway

[21] Appl. No.: 44,557

[22] Filed: Jun. 1, 1979

Related U.S. Application Data

[63] Continuation-in-part of Ser. No. 872,304, Jan. 25, 1978, abandoned.

[30] Foreign Application Priority Data

Jan. 27, 1977 [NO] Norway ..... 770272

[51] Int. Cl.[3] ..... E01C 19/45

[52] U.S. Cl. ..... 126/343.5 A; 165/108; 165/109 R

[58] Field of Search ..... 126/343.5 R, 343.5 A; 366/168, 167; 165/108, 109; 208/39, 44

[56] References Cited

U.S. PATENT DOCUMENTS

| | | | |
|---|---|---|---|
| 1,560,826 | 11/1925 | Kirschbraun | 126/343.5 |
| 1,734,747 | 11/1929 | Seeley | 366/168 |
| 1,975,433 | 10/1934 | Rhodes | 126/343.5 |
| 2,001,344 | 5/1935 | Fielder | 126/343.5 |
| 2,006,586 | 7/1935 | Downard | 126/343.5 |
| 2,340,207 | 1/1944 | Sherrill | 126/343.5 |
| 2,360,665 | 10/1944 | Fields | 126/343.5 |
| 3,332,413 | 7/1967 | Hendriks | 126/343.5 |
| 3,363,672 | 1/1968 | Ohsol | 126/343.5 |
| 3,369,873 | 2/1968 | Ullrich | 126/343.5 |
| 3,841,303 | 10/1974 | Martin | 126/343.5 |

*Primary Examiner*—Daniel J. O'Connor

*Attorney, Agent, or Firm*—Eyre, Mann, Lucas & Just

[57] ABSTRACT

Heated molten material is circulated in a closed cycle between a heater and a storage tank. The heater is controlled to maintain the temperature of the circulating fluid at a predetermined level. A replenishment supply of solid material to be melted is mixed with the heated fluid during retention in a melting container during the circulation from heater to storage tank.

21 Claims, 3 Drawing Figures

METHOD AND ARRANGEMENT FOR MELTING OF PITCH ETC.

This is a continuation-in-part of application Ser. No. 872,304 filed Jan. 25, 1978, now abandoned.

BACKGROUND OF THE INVENTION

Many industrial processes require the melting of large quantities of solid material and the maintenance of the resulting melted fluid at a uniform temperature and uniform consistency.

The present invention relates to the melting of pitch and the like which is later used in the molten state. Pitch has heretofore been melted in a large container to which heat was supplied and new solid pitch added as molten pitch is withdrawn. This, however, has inherent disadvantages.

Pitch contains a substantial portion of water which is driven off by the melting temperature of between about 180° and 200° C. When new pitch is added at the top of the large container, the process of driving off the water causes local cooling and lumps in the vicinity of the fresh pitch. Consequently, non-uniform temperature and lumps are formed in the melted material which frequently remain for long enough to be drawn from the tank into the using process, a highly undesirable result. Many industrial processes also include the melting of solid materials and are hampered with lumpy and/or variable temperature melted material. The present invention can be used also in these processes.

SUMMARY OF THE INVENTION

The present invention overcomes the disadvantages of the known process by cycling of the melted material in a closed cycle from a storage tank, through a heater and back into the storage tank. In its passage through the heater, the temperature of the melted material is adjusted so that the outflow of melted material from the heater is maintained in the desired temperature range. For melted pitch, for example, the desired temperature range is from about 180° to about 200° C.

The outflow from the heater is passed into a small melting container prior to its being returned to the storage tank. The circulating flow rate of the melted material is high enough to cause turbulence and mixing in the small melting container.

A replenishment supply of solid material to be melted is added to the melting container and mixed therein by the turbulence of the melted material being circulated therein. The volume of melted material being circulated into the melting container per unit of time is far in excess of the volume of replenishment solid material being added. Consequently, there is adequate heat in the large volume of melted material circulating through the melting container to melt the replenishment solid material.

The circulation rate of the melted material is sufficient to recirculate the entire contents of the storage container through the system as frequently as several times per hour. This high circulation rate combined with the turbulent mixing which takes place in the melting container as well as the mixing which occurs in transferring the melted and mixed material from the melting container into the storage container ensures substantially uniform mixing and temperature of the melted material.

Most of the water in the replenishment solid material is driven off as water vapor or steam from the melting container and therefore does not reach the storage container. Alternatively, the storage container may be a closed vessel from the top of which may be drawn off water vapor, steam and volatile components driven off the replenishment solid material. These gases and vapors may be passed through a condenser and separator which condenses the gases and vapors. Condensed water may be discharged from the system. Other condensed volatile materials may optionally be separated from the condensed water and returned to the circulating system.

The melted material is fed to the using process preferably from the outlet side of the heater. This helps to ensure that the delivered melted material has the desired temperature. As the melted material is drawn off for use the changing level in the storage container may be sensed and additional solid material may be added. Alternatively, non-automatic replenishment may be performed. For example, an operator may monitor the level of melted material in the storage container, and, when it becomes depleted to a certain level, he may initiate the adding of solid material to be melted.

DETAILED DESCRIPTION OF THE PREFERRED EMBODIMENT

Figure 1:
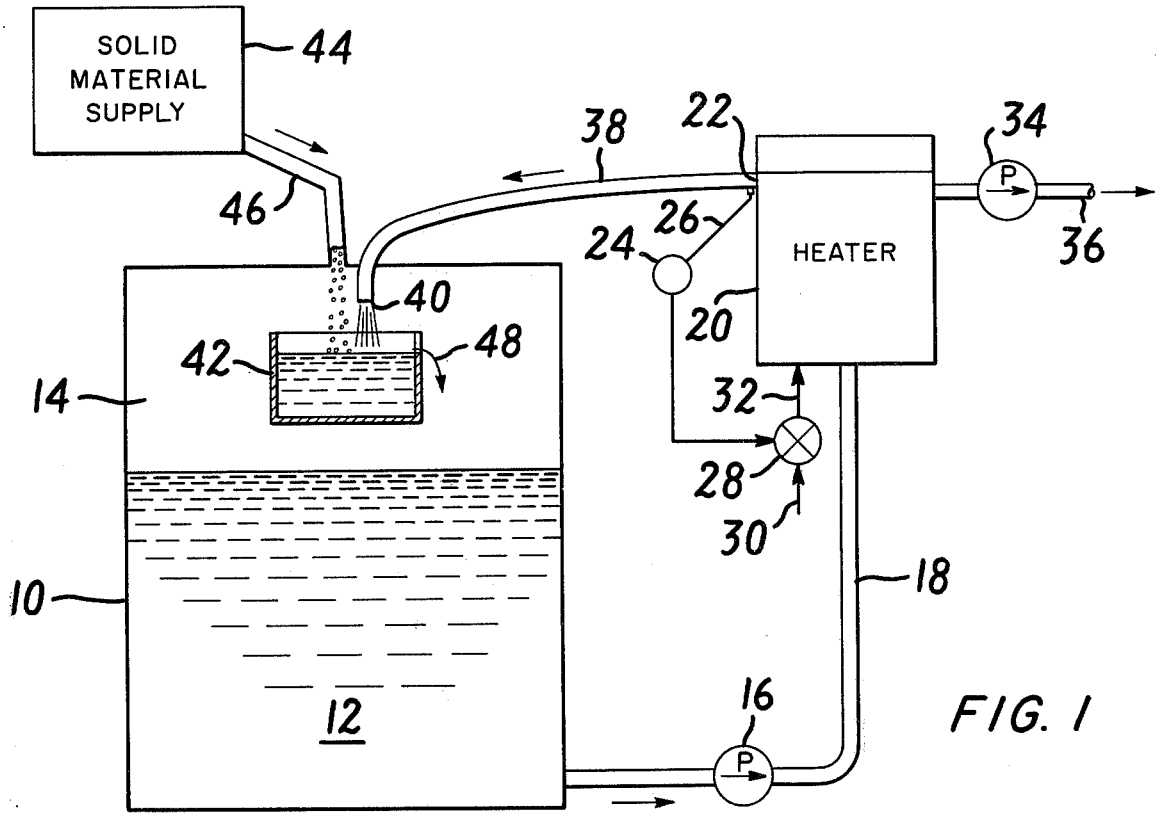
FIG. 1 shows a schematic diagram of the melting system according to the present invention.

Referring now to FIG. 1, a storage container 10 holds a supply of melted material 12. The storage container 10 may be insulated by means well known in the art in order to retain the heat in the supply of melted material 12 and also to reduce the temperature variations throughout the material. The supply of melted material 12 only partially fills the storage container 12 leaving a clear space 14 above it.

A pump 16 which may be continuously or discontinuously operated draws some of the melted material from the bottom of the storage container 10 and pumps it via conduit 18 to a heater 20.

The heater 20 may be of any convenient type well known in the art such as a heat exchanger fed by hot fluid or steam or it may contain a fossil fueled burner or an electric heater therein. As the melted material passes through the heater 20, the heat added is controlled to provide a predetermined temperature at its outlet 22. One possibly way of controlling the heat added in the heater 20 is, for example, the temperature sensor 24 which has its sensing probe at or near the outlet 22 of the heater 20. The temperature sensor 24 controls for example a thermostatically controlled valve 28. The thermostatically controlled valve 28 thereupon controls the flow of heating medium from inlet conduit 30 to conduit 32 which delivers the heating medium to the heater 20. If the heating medium is steam, for example, the heater 20 may be a heat exchanger in which the steam passes in a cycle through the heater 20 isolated from the melted material and exits the heater 20 by a conduit not shown for venting or for return to the source of steam. Similarly, if the heating medium is fossil fuel gas, coal or oil, additional mechanisms such as burners, blowers, fire pots and exhaust stacks, all well known in the art, are required. Since the heater 20 may be of any design known or to become known in the art, a detailed treatment of its internal workings is omitted.

Other means of controlling the temperature of the melted material at the outlet 22 of the heater 20 are possible. For example, pump 16 may be a variable speed pump. The temperature sensor 24 may be arranged to vary the speed of the pump 16 while the heater 20 supplies a constant quantity of heat. By passing the melting fluid through the heater 20 faster or slower depending upon the temperature of the outlet 22, the required control of temperature of the melted material is achieved.

Heated melted material is drawn off near the top of the heater 20 by pump 34 and delivered by a conduit 36 to the using process. The amount of material drawn off by pump 34 is substantially less than the amount of melted material being circulated through the system by pump 16. The amount of heated material circulated by pump 16 may be as much as from about 2 times to as much as several hundred times the amount drawn off by pump 34. In the preferred embodiment, the amount of heated material pumped by pump 16 is between about 3 and about 55 times the amount of material pumped by pump 34 but is preferably between about 10 and 30 times. In one embodiment in which the heated material was pitch, pump 34 pumped 3 tons of heated pitch per hour and pump 16 pumped about 60 tons of heated pitch per hour.

The outflow from outlet 22 is conveyed via conduit 38, returning it to the storage container 10. Conduit 38 may advantageously be sloped downward as shown in order to aid the delivery of melted material by gravity.

The melted material is discharged from conduit 38 through outlet 40 and into a melting container 42 positioned in the clear space 14 above the supply of melted material 12.

A solid material supply 44 which may be of any convenient form known in the art provides a supply of solid material via conduit 46 to the melting container 42. The solid material being supplied may be of any form such as powder, granules, chunks or slabs, but is preferably relatively finely comminuted in order to increase the surface area in contact with the heated molten material in the melting container. In the application in which pitch was heated, best results were obtained when the pitch was crushed to a maximum particle size of three mm with 70 percent of the material less than one mm particle size.

Alternatively, the solid material supply 44 may preheat the replenishment material before delivering it to melting container 42. Thus the replenishment material may be softened or fully melted when it is added to the circulating melted material.

The melting container 42 is sized to provide a retention time of the molten material and replenish material long enough to achieve substantially complete melting and unification of the new material with the old as well as giving an opportunity for driving off the initial emissions of the replenishment material such as water, vapor, and gases before the mixture is deposited in the storage container 10. At the flow rates mentioned in the preceding, a melting container having a capacity of 0.3 $m^3$ provided a retention time of approximately 50 seconds. Longer or shorter retention times may be chosen for other materials. The retention times can be increased by increasing the capacity of the melting container 42 or reducing the pumping rate of pump 16. The retention time can be reduced by the converse. The provision of good mixing and turbulence in the melting container 42 may be utilized to minimize the required retention time.

The outflow 48 from the melting container 42 is returned to the supply of melted material in the storage container 10.

It is contemplated that the addition of solid material by solid material supply 44 may be continuous or discontinuous. The solid material supply 44 may be a hopper with a gate, not shown, a screw feeder, not shown, or any other device known in the art which will provide solid material at the rate and with the consistency required. On the long term average, the amount of material supplied by solid material supply 44 must be equal to the amount of melted material pumped to the using process by output pump 34 less various losses such as water and gases driven off by the melting process and not returned to the system. Thus, if 3 tons of material are pumped off per hour to the using process by pump 34, then at least 3 tons solid material must be delivered by solid material supply 44 per hour.

In order to maintain uniform temperature throughout the system and to obtain good mixing, the relationship between the capacity of storage container 10 and the pumping capacity of pump 16 is established such that the entire supply of melted material 12 is circulated through the system often enough to achieve these results. In a pitch melting apparatus reduced to practice, satisfactory results were obtained with a storage container 10 capacity of from about 10 to about 20 tons combined with a circulating flow rate of about 60 tons per hour. Thus, for this application, the supply of molten material 12 was completely circulated from about 3 to about 6 times per hour. For other applications, flow rates of between 0.5 and 100 times the storage container 10 capacity may be employed.

Figure 2:
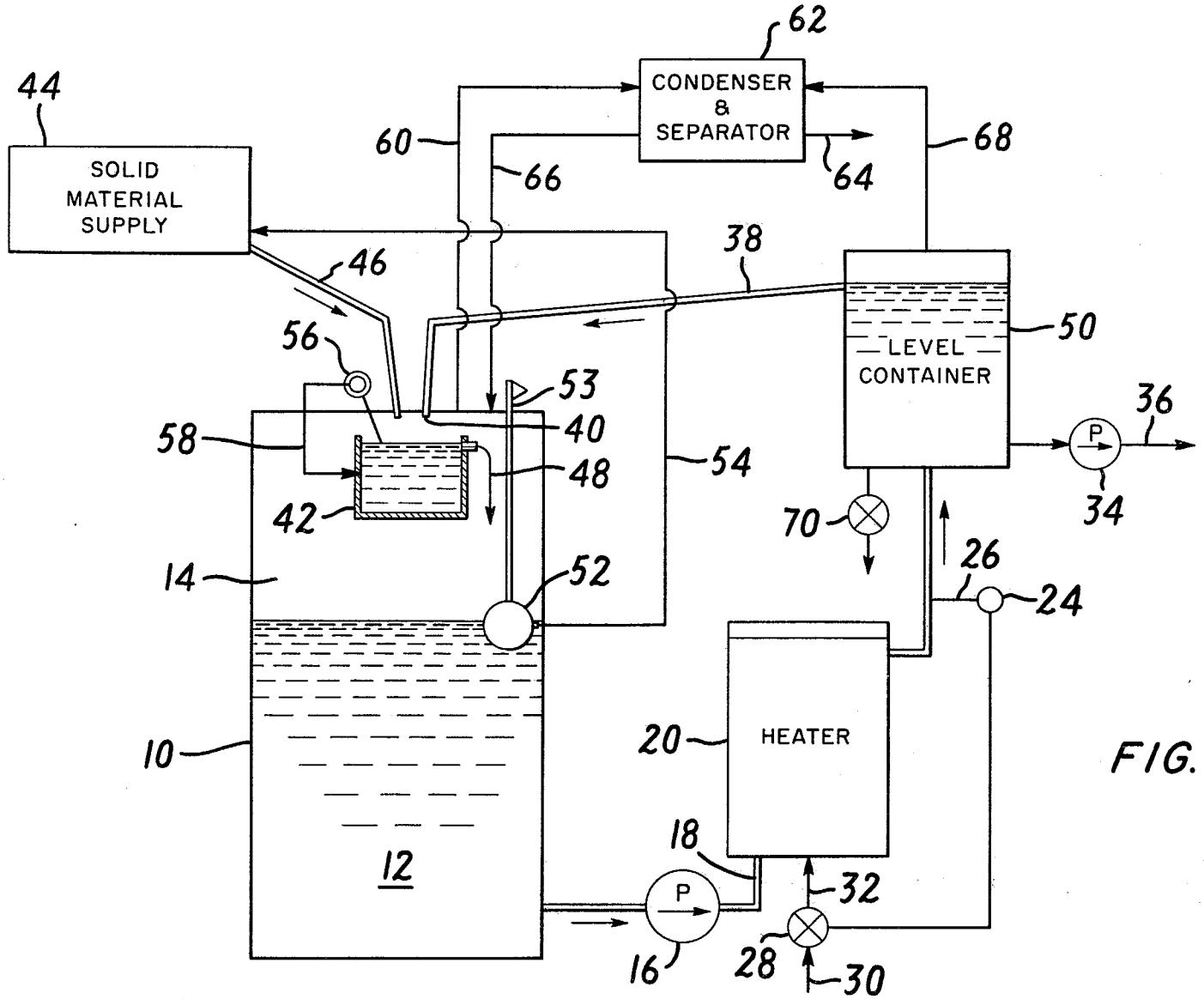
FIG. 2 shows a second embodiment of the invention.

Turning now to the embodiment of the invention shown in FIG. 2, wherein like reference numerals are used for corresponding parts, a level container 50 is interposed between the heater 20 and the conduit 38 which returns the heated melted material to the storage container 10. The pump 34 draws the material for the using process from near the bottom of the level container 50. The level container 50 provides a constant head pressure for the pump 34 and for the conduit 38.

A level sensor 52 in the storage container 10 senses the level of the supply of melted material 12. The level sensor 52 may be a simple float which raises or lowers an indicator flag 54 which the operator may read in order to determine whether or not additional replenishment material is required to make up for the amount used. Alternatively, the level sensor 52 may be a device which generates an electrical, pneumatic or mechanical signal which is transmitted via a signal line 54 to the solid material supply 44. The signal on the signal line 54 may be used in the solid material supply 44 to control the flow of material to conduit 46 thereby maintaining the level of fluid in the storage container at a relatively constant level.

A melting container level sensor 56 may optionally be provided which generates a control signal on control line 58 which varies the fluid level in the melting container 42. Depending on the application, the signal line 58 may operate directly on the melting container 42 to vary the overflow level or outflow 48 size, or alternatively may be connected to vary the pumping speed of the pump 16 and thereby raise the level in the level container 50 causing more material to flow through conduit 38 into the melting container 42. Other means may also be devised for the control of the level in melting container 42 under the control of melting container level sensor 56.

The storage container 10 shown in FIG. 2 may preferably be a closed container having a gas and vapor discharge line 60 leading to a condenser and separator 62. The gas and vapor discharge line 60 as well as the clear space 14 may be maintained at a slightly negative pressure in order to draw off gases and vapors emitted during the melting and holding process. These gases and vapors are condensed in condenser and separator 62 and the undesired condensed components such as water are discharged on discharge line 64. Desired condensed components may be returned to the storage container 10 by way of a return line 66.

Level container 50 may also be a closed container with a gas and vapor discharge line 68 connected to its top. Although no actual melting should go on in the level container 50, the addition of heat to the melted material on its way to this location may release additional water or gases. Since the level container 50 is normally the highest point in the system containing melted material, gases and vapors would collect here if not carried off.

A sediment drain valve 70 may be installed in the bottom of the level container 50 to permit drawing off of sediment and impurities which may collect in the bottom of the level container 50.

Figure 3:
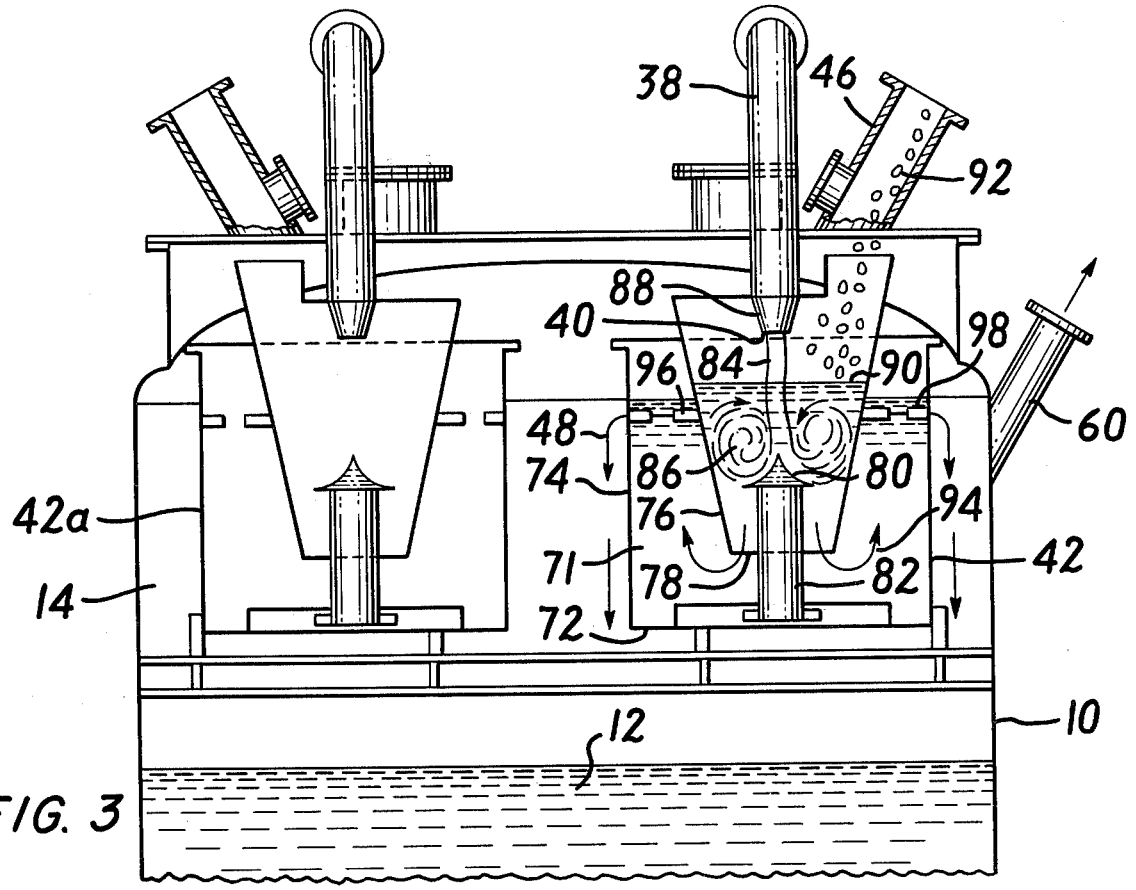
FIG. 3 shows a cross sectional view of a portion of the system including two melting containers.

Referring now to FIG. 3, there is shown a cross section of the top of a storage container 10 in which two melting containers 42 and 42*a* are employed. The two melting containers 42 and 42*a* may be used alternately or simultaneously but are preferably used alternately to enable maintenance and cleaning of the circulating system associated with one melting container while the melting process is continued with the other melting container.

For purposes of the present description, the melting containers 42 and 42*a* are identical. Consequently, only a detailed description of melting container 42 will be given.

Melting container 42 has an outer vessel 71 having a bottom 72 and sides 74 and an inner vessel 76 in the shape of an inverted cone having an open bottom 78.

A stream splitter 80 is centrally supported within a inner vessel 76 by a support 82 which, in turn, rests on the bottom 72 of the outer vessel 71. The stream splitter 80 could alternatively be supported on spiders extending inward from the inner vessel 76. The stream splitter 80 has a pointed cap aligned with the outlet 40. The stream 84 of molten material from outlet 40 impacts on the stream splitter and is split into turbulent eddies 86 shown above and to the sides of the stream splitter 80. The conduit 38 terminates in a conical nozzle 88 in order to impart the maximum velocity to the stream 84 as it strikes the stream splitter 80 and consequently produce maximum turbulence in inner vessel 76.

The flow restriction caused by the stream splitter 80, the size of the open bottom 78 restricted by the support 82, and the turbulence in the inner vessel 76 limit the rate at which the incoming stream 84 can exit the open bottom 78 of the inner vessel 76. Consequently, the fluid level 90 in the inner vessel 76 tends to remain well above the stream splitter 80. The granules 92 of solid material to be melted are directed by conduit 46 generally into the region within the inner vessel 76 where the turbulent eddies 86 will provide good mixing and agitation. The granules 92 become rapidly mixed with the melted fluid in the inner vessel 76 and are retained there for a long enough average time that melting should be substantially complete before the freshly added material leaves the inner container.

Part of the melted fluid leaves the inner vessel 76 through the bottom 78 as indicated by the arrows 94. An overflow 96 discharges excess fluid from the inner vessel 76 into the outer vessel 71. The melted material passes through the outer vessel 71 and eventually through overflows 98 to form the outflow 48 which is returned to the supply of melted material 12 in the storage container 10. By requiring the melted material to pass through the outer vessel 71, the retention time of the material in the melting container is further increased.

It will be understood that the claims are intended to cover all changes and modifications of the preferred embodiments of the invention, herein chosen for the purpose of illustration which do not constitute departures from the spirit and scope of the invention.

What is claimed is:

1. Apparatus comprising:

(a) storage means for storing heated melted material;

(b) heating means for adding heat to said melted material;

(c) circulating means for circulating said melted material from said storage means, through said heating means and returning it to said storage means;

(d) at least one melting container interposed in the circulation of said melted material being returned to said storage means;

(e) means for adding material to be melted to said melting container;

(f) said storage means being no more than partly full of said heated melted material, whereby a free space is left over the surface of said heated melted material;

(g) said at least one melting container being disposed in said free space above said surface;

(h) a roof sealably closing the top of said storage means and enclosing said at least one melting container therein; and (i) means for drawing off gases and vapors from said free space.

2. The apparatus recited in claim 1 further comprising level container means between said heating means and said storage means for maintaining a substantially constant pressure head.

3. The apparatus recited in claim 1 wherein said circulating means has a circulation capacity from about 10 to about 30 times the rate of addition of material to be melted.

4. The apparatus recited in claim 3 further comprising output means for removing melted material.

5. The apparatus recited in claim 3 further comprising said means for adding being capable of adding material to be melted at least as fast as said output means is capable of removing melted material.

6. The apparatus recited in claim 4 wherein said output means removes material from the system between said heating means and said storage means.

7. The apparatus recited in claim 1 further comprising:

(a) turbulence generating means in said melting container for producing turbulence in the melted material passing thereinto; and (b) said means for adding being operative to add the material to be melted to said turbulence.

8. The apparatus recited in claim 7 further comprising said at least one melting container having a retention time of the added material long enough to provide substantially complete melting of the added material before it leaves the melting container.

9. The apparatus recited in claim 1 further comprising condenser means connected to said means for drawing off for condensing at least some of said gases and vapors into liquid.

10. The apparatus recited in claim 9 further comprising separator means for separating at least first and second components of said liquid.

11. The apparatus recited in claim 10 further comprising means for returning at least one of said first and second components to the melted material.

12. The apparatus recited in claim 1 further comprising means for automatically actuating said means for adding whereby a substantially constant quantity of melted material remains.

13. The apparatus recited in claim 1 further comprising:

(a) thermostatic sensor means for sensing the temperature of the melted material at an outlet of said heating means and for generating a control signal in response thereto; and (b) thermostatically controlled means responsive to said control signal for maintaining the temperature at said outlet within a predetermined temperature range.

14. The apparatus recited in claim 1 further comprising at least one melting container being at least two melting containers.

15. The apparatus recited in claim 1 wherein said circulating means has a circulation capacity at least about three times the rate of addition of material to be melted.

16. Apparatus comprising:

(A) storage means for storing heated melted material;

(B) heating means for adding heat to said melted material;

(C) circulating means for circulating said melted material from said storage means, through said heating means and returning it to said storage means;

(D) at least one melting container interposed in the circulation of said melted material being returned to said storage means;

(E) means for adding material to be melted to said melting container; and wherein (F) said at least one melting container comprises:

(a) an outer vessel having a bottom and sides;

(b) an inner vessel within said outer vessel;

(c) said inner vessel being open at top and bottom;

(d) a stream splitter within said inner vessel aligned with the circulating melted material entering said melting container;

(e) said stream splitter being operative to produce turbulence in the circulating melted material in said melting container;

(f) said means for adding being operative to deposit said material to be added in said turbulence;

(g) means for forcing said circulating melted material to pass from said inner vessel to said outer vessel; and (h) overflow means in said outer vessel for permitting said melted material to overflow from said outer vessel into the heated melted material stored in said storage means.

17. The apparatus recited in claim 16 further comprising a nozzle directing said melted material onto said stream splitter.

18. The apparatus recited in claim 16 wherein said circulating means has a circulation capacity at least about three times the rate of addition of material to be melted.

19. Apparatus for melting and mixing pitch comprising:

(a) storage tank means for containing a quantity of heated melted pitch;

(b) a thermostatically controlled heater;

(c) a melting tank;

(d) a circulating pump for circulating melted pitch from said storage tank, through said heater and into said melting tank;

(e) overflow means in said melting tank for returning the circulating melted material to said storage tank;

(f) an output pump for removing melted pitch;

(g) solid material supply means for adding a metered amount of solid pitch to be melted to said melting tank;

(h) said metered amount having a flow rate at least as large as the flow rate of said output pump;

(i) the flow rate of said circulating pump being at least 10 times the flow rate of said metered amount; and (j) said circulating pump having an hourly flow rate at least three times the quantity of heated melted pitch in said storage tank.

20. The apparatus recited in claim 19 further comprising level container means between said heater and said melting tank for maintaining a constant pressure head to said output pump.

21. The apparatus recited in claim 20 further comprising:

(a) a roof on said storage tank;

(b) means for drawing gases and vapors from said storage tank and level container;

(c) condenser means for condensing at least part of said gases and vapors; and (d) separator means for separating at least water from condensed gases and vapors and for returning at least part of said condensed gases to said storage tank.

* * * * *